US005910707A

United States Patent [19]

Bell

[11] Patent Number: 5,910,707

[45] Date of Patent: Jun. 8, 1999

[54] TUNGSTEN HALOGEN LAMP

[75] Inventor: Dean A. Bell, Marcellus, N.Y.

[73] Assignee: Welch Allyn, Inc., Skaneateles Falls, N.Y.

[21] Appl. No.: 08/881,904

[22] Filed: Jun. 25, 1997

Related U.S. Application Data

[63] Continuation-in-part of application No. 08/398,518, Mar. 3, 1995, abandoned.

[51] Int. Cl.[6] ..... H01K 1/22

[52] U.S. Cl. ..... 313/579; 313/578; 313/636; 501/65; 501/68; 501/70

[58] Field of Search ..... 313/579, 578, 313/569, 573, 580, 636, 315; 501/49, 54, 64, 65, 66, 68, 69, 70, 133, 905

[56] References Cited

U.S. PATENT DOCUMENTS

| | | | |
|---|---|---|---|
| 3,563,772 | 2/1971 | Joormann et al. | 313/636 X |
| 4,060,423 | 11/1977 | Thomas | 106/52 |
| 4,089,694 | 5/1978 | Thomas et al. | 106/53 |
| 4,105,826 | 8/1978 | Thomas | 313/636 X |
| 4,238,704 | 12/1980 | Bonk et al. | 313/113 |
| 4,238,705 | 12/1980 | Thomas | 313/318 |
| 4,354,139 | 10/1982 | Konijnendijk et al. | 313/636 X |
| 4,409,337 | 10/1983 | Dumbaugh, Jr. | 501/66 |
| 4,409,516 | 10/1983 | Thomas et al. | 313/579 |
| 4,441,051 | 4/1984 | Thomas | 313/636 X |
| 4,666,871 | 5/1987 | Spierings et al. | 313/636 X |
| 4,684,847 | 8/1987 | Spierings et al. | 313/636 X |
| 4,734,388 | 3/1988 | Cameron et al. | 313/480 X |
| 4,737,685 | 4/1988 | Thomas | 313/636 X |
| 4,792,535 | 12/1988 | Fine | 501/66 |
| 4,952,539 | 8/1990 | Greber et al. | 501/66 |
| 5,182,237 | 1/1993 | Brix | 501/66 |
| 5,434,111 | 7/1995 | Clement et al. | 501/63 |
| 5,523,650 | 6/1996 | Terheijden et al. | 313/636 X |

*Primary Examiner*—Ashok Patel
*Attorney, Agent, or Firm*—Wall Marjama Bilinski & Burr

[57] ABSTRACT

A glass halogen lamp which exhibits improved short wavelength light transmission and emission having a glass envelope which is made of a glass composition of the aluminosilicate system in which the iron content of the composition is between 10 and 100 ppm. The glass envelope of the lamp may optionally contain an area of reduced wall thickness which further enhances short wavelength light transmission and emission.

7 Claims, 1 Drawing Sheet

TUNGSTEN HALOGEN LAMP

This is a continuation-in-part of U.S. Ser. No. 08/398,518 filed Mar. 3, 1995 now abandoned.

BACKGROUND OF THE INVENTION

The present invention relates in general to lamps, and more specifically to tungsten halogen lamps or inert gas filled lamps having an improved glass envelope.

Tungsten halogen lamps have long been used in industry and provide certain advantages over conventional incandescent lamps. For example, the light emitted from the tungsten halogen lamp has a higher color temperature, is generally whiter, and the lamp can be made in much smaller dimensions than conventional lamps, while still producing an equivalent or greater amount of light. Furthermore, the intensity of the illumination from tungsten halogen lamps remains virtually constant throughout the life of the lamp. In addition, tungsten halogen lamps exhibit a significantly longer working life than conventional incandescent lamps. Although envelopes for tungsten halogen lamps of this type can be prepared from fused quartz and 96% silica glass compositions, these materials are difficult to form and lampwork due to their high working temperatures and their low coefficients of thermal expansion which necessitate special sealing techniques to introduce the lead wires into the lamps. Electrical leads must be introduced in the form of molybdenum foils with welded leads attached, thus achieving a means of supplying electrical current to the filament and at the same time achieving a hermetic seal. Such foil seals restrict the size reduction of a lamp and preclude an exhaust tube at the bottom of the lamp. Exhausting such lamps occurs through an exhaust tube located at the top end of the lamp and when tipped off leaves a knob of glass at the top of the lamp envelope, often referred to as top tipoff. This top tipoff becomes an optical obstruction when attempting to focus on the filament or to project light from a lens.

A distinct advantage for glass halogen lamps having envelopes made of conventional aluminosilicate glass is that the leads are introduced as lead wires and foils are not required. This then allows for considerable reduction in the size of the lamp. Further, the tipoff may occur at the bottom of the lamp between the lead wires, often referred to as the bottom tipoff. This then allows for the top end of the lamp to remain essentially optically clear for focusing on the filament and may contain a lens to project light. The ability to utilize the lamp from the end of the envelope is of considerable importance. For example, in spectroscopy, analytical chemistry, blood and serum analysis, medical diagnostics and clinical chemistry, end on use thru the clear hemispherical or lensed end has a significant positive effect on the design and use of instrumentation. The quartz lamp with its inherent top tipoff has a negative effect requiring the instrument designer to work around this optical obstruction. Further, the use of envelopes made of aluminosilicate glass allow for size reductions of the halogen lamp and allow the designer to design, with miniaturization in mind, a smaller instrument which is advantageous to hand held instrumentation and portable instrumentation. Therefore, there are distinct advantages in making halogen lamps from aluminosilicate glass.

For purposes of this invention aluminosilicate glass may be defined as glass with an $SiO_2$ base, with a relatively high concentration by weight of $Al_2O_3$ and with secondary composition oxides of BaO, CaO, and to a much lesser concentration the composition oxides of MgO and $B_2O_3$. Commercially available aluminosilicate glasses fall into the broad composition by weight range set forth in Table I shown below:

TABLE I

| | |
|---|---|
| $SiO_2$ | 53–76% |
| $Al_2O_3$ | 9–18% |
| $B_2O_3$ | 0–6% |
| CaO | 3–13% |
| MgO | 0–9% |
| BaO | 5–24% |

Such glasses have significant commercial value in the lamp industry for tungsten halogen regenerative cycle lamps as this family of glasses is characterized by a high thermal strain point, chemical compatibility, direct sealing to molybdenum lead wires and are easily worked.

A disadvantage of currently available aluminosilicate glasses for use in tungsten halogen lamps is the poor transmission of short wavelength light of less than about 400 nm. This puts the tungsten halogen lamp with glass envelopes made of these materials at a distinct disadvantage in that they do not achieve levels of near ultraviolet or ultraviolet (UV) light emission that can be derived from a tungsten halogen lamp with a quartz envelope of the same wattage and color temperature due to the fact that quartz glass has a higher transmission of light (transmittance) below 400 nm.

It can therefore be seen that there is a need in the field for tungsten halogen lamp envelopes made from glass compositions which can provide for both the working, sealing and performance properties associated with aluminosilicate glass systems, and which also exhibit increased transmission of UV light.

SUMMARY OF THE INVENTION

The principal object of the present invention is directed to the use of aluminosilicate glasses which are especially suitable for envelopes in tungsten halogen lamps. The use of these glasses apply equally to their use as envelopes for inert gas filled lamps. It has been discovered that glass envelopes of the present invention exhibit increased short wavelength transmission, previously unattainable from glass compositions available in the art. In accordance with the present invention, it has been discovered that increased short wavelength transmission can be accomplished in glasses of the aluminosilicate system. Glasses of this type typically exhibit up to 65% light transmission at 340 nm for a 1 mm thick section. It has been discovered that the major reason for this relatively low transmission is largely due to the inherent residual concentration of iron generally greater than approximately 400 ppm of the glass composition. By reducing the iron level to as low as possible, preferably 100 ppm or less, transmission in the UV range was increased up to about 82% at 340 nm for a 1 mm thick section. Further improvement in short wavelength transmission can be obtained utilizing a thinner wall thickness at appropriate sections of the envelope in combination with the reduced iron content in order to achieve even higher levels of UV light output from a tungsten halogen lamp.

DETAILED DESCRIPTION OF THE INVENTION

Figure 4:
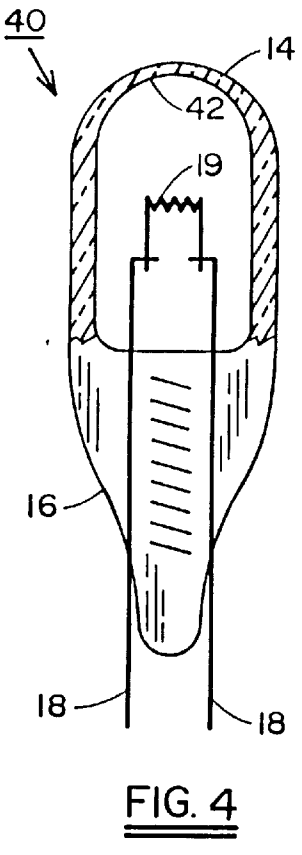
FIG. 4 is a sectional view of a fourth embodiment of a tungsten halogen lamp of the present invention.
Figure 3:
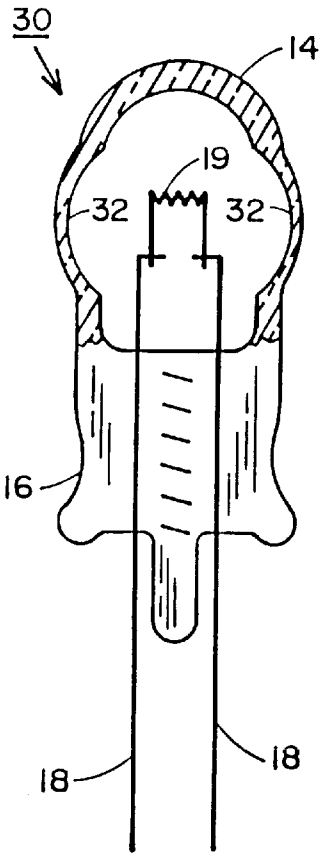
FIG. 3 is a sectional view of a third embodiment of a tungsten halogen lamp of the present invention.
Figure 2:
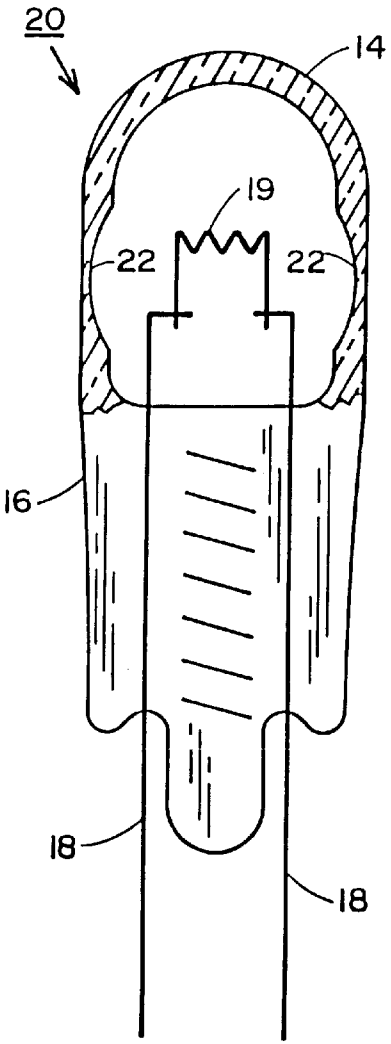
FIG. 2 is a sectional view of a second embodiment of a tungsten halogen lamp of the present invention.
Figure 1:
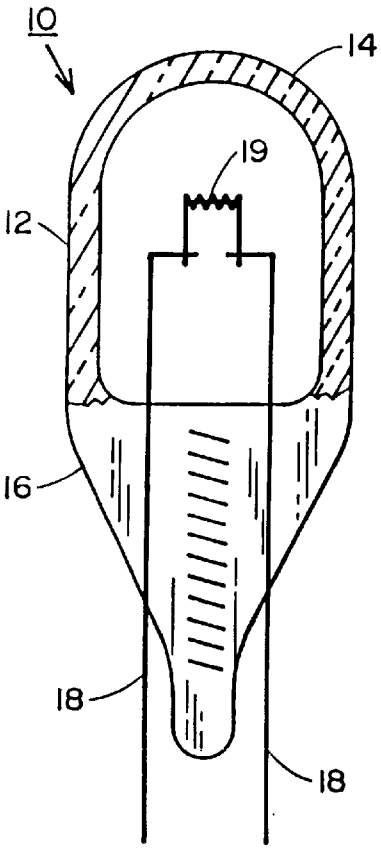
FIG. 1 is a sectional view of one embodiment of a tungsten halogen lamp of the present invention.

Referring more specifically to the drawings, FIG. 1 schematically illustrates a partial view of a typical tungsten halogen lamp of the present invention, exhibiting a smooth dome or hemispherical end. As shown in FIG. 1, the lamp 10 comprises an outer glass envelope 12 having a hemispherical end section 14 and a lower section 16 typically referred to as the seal area containing lead wires 18 hermetically sealed to the glass and connected to an internal filament 19. The lead wires are typically made of molybdenum, and the filament of tungsten. In the embodiments illustrated in FIGS. 2, 3, and 4, lamps 20, 30, and 40 illustrate various embodiments regarding the shape of the lamp envelope. In addition, selected sections of reduced wall thickness which further enhance short wavelength light transmission are shown in FIGS. 2, 3 and 4 at locations 22, 32, and 42, respectively. The shape of the lamps illustrated in FIGS. 1–4 and their respective sealing arrangement may be varied depending upon the application and end use of the lamp.

U.S. Pat. Nos. 4,409,337, 4,238,705, 4,409,516 and 4,060,423 teach conventional lamp manufacturing techniques, configurations, and general aluminosilicate glass formulations which are suitable for use in the present invention and are incorporated herein by reference.

The present invention is based upon the discovery that by controlling iron content to levels no greater than about 100 ppm, (i.e. a range of about 10–100 ppm) in glass compositions of the aluminosilicate system, significant increases in UV transmission are obtained, providing the advantages of increased transmission for conventional clear glass hemispherical, flat top and lensed end envelopes for use in medical, analytical and optical applications. From a practical standpoint, a realistic minimum concentration for the iron is about 10 ppm due to manufacturing constraints. Therefore, the practical operable range for the iron content for aluminosilicate glass of the present invention is from about 10 to 100 ppm. This increase in UV transmission also provides the advantage of being able to utilize smaller diameter lamps than are presently available for quartz halogen lamps. Using the glass envelopes of the present invention, lamp sizes down to 0.100 inches in diameter can be manufactured. A further advantage is being able to utilize the lamp in an end-on orientation.

Five typical aluminosilicate glass compositions which would be normally suitable for use in the present invention are listed below in Table 2. These compositions, however, normally contain iron in residual or trace amounts greater than about 400 ppm of the glass composition. These glass compositions, because of their iron content, exhibit relatively low transmission in the UV range.

TABLE 2

| | Glass Composition in Weight Percent | | | | |
|---|---|---|---|---|---|
| Composition | I | II | III | IV | V |
| $SiO_2$ | 56–59% | 71–76 | 54–71 | 56–63 | 55–68 |
| $Al_2O_3$ | 16–17% | 9–12 | 12–18 | 13–17 | 15–18 |
| $B_2O_3$ | 4.5–5.25% | | | | |

TABLE 2-continued

| | Glass Composition in Weight Percent | | | | |
|---|---|---|---|---|---|
| Composition | I | II | III | IV | V |
| CaO | 7.5–9.25% | 3–13 | 4–8 | 1–4.5 | 7–13 |
| MgO | 5.5–6.25% | | | | |
| BaO | 5–9% | 5–10 | 10–23 | 19–24 | 6–16 |
| Fe | ≧400 ppm | ≧400 | ≧400 | ≧400 | ≧400 |

Table 3 represents a specific glass composition of the type of Composition I in Table 2, in which the iron content has been carefully controlled to be 98 ppm. The iron content is controlled by techniques which are conventional in the art in monitoring or controlling trace elements and/or impurities. This is typically accomplished by the selection of tooling and the melt vessel to eliminate or control the addition of impurities in the glass composition during processing. In addition, the selection and assay of the individual components of the glass formulation are carefully controlled to insure that the iron content is carefully monitored.

TABLE 3

| Glass Composition in Weight Percent | | |
|---|---|---|
| $SiO_2$ | 54.6 | ±.3 |
| $A_2O_3$ | 17.0 | ±.2 |
| MgO | 5.8 | ±0.05 |
| CaO | 8.2 | ±0.05 |
| BaO | 8.1 | ±0.1 |
| $B_2O_3$ | 5.6 | ±0.1 |
| NaO | .13 | ±.002 |
| Fe | 98 ppm | |

In Table 4 the known light transmission of glass compositions of Composition I of Table 2 is tabulated at 340 nm for a 1 mm wall thickness of the glass. This transmission is compared to the observed transmission of the glass composition of Table 3 and to the known transmission of quartz under the same test conditions.

TABLE 4

| Transmission @ 340 mn And 1 mm Wall |
|---|
| 65% @ 400 ppm Fe (Comp. I Table 2) |
| 82% @ 98 ppm Fe (Comp. Table 3) |
| 91% QUARTZ |

As can be seen from the data in Table 4, light transmission at 340 nm for the type of glass under consideration increases from 65% at 400 ppm iron to 82% for 98 ppm iron. Comparative light transmission for an equivalent quartz envelope at the same wavelength of 340 nm with a 1 mm wall thickness is 91%. It can, therefore, be seen that the transmission level for the glasses under consideration with the low iron content compare favorably with the quartz envelopes, while providing significant performance and process advantages over quartz as set forth above.

In addition to the above, the working characteristics of glasses of the type under consideration are important. In a comparison of the various working characteristics such as softening point, anneal point, strain point, density and expansion coefficient of the conventional glass composition of Table 2 having an iron content of about 400 ppm has compared to the composition of the present invention in which the iron content was 98 ppm. The results of the comparison of the working properties are set forth in Table 5 below.

TABLE 5

| | Units | Commercial Aluminosilicate Composition I, Table 2 | Low Fe Aluminosilicate, Table 3 |
|---|---|---|---|
| Soften Point | ° C. | 925 +/− 5 | 928 |
| Anneal Point | ° C. | 722 +/− 5 | 725 |
| Strain Point | ° C. | 674 +/− 10 | 678 |
| Density | $g/cm^3$ | 2.64 +/− .01 | 2.637 |
| Exp Coeff | $\times 10^{-7}/c$ | 44 +/− 1 | 44.3 |
| Fe Content | ppm | ≧400 | 98 |

It can be seen from the results shown in Table 5 that the low iron composition glass envelopes of the present invention will meet the required standard physical specifications as set forth for commercial aluminosilicate glass of Composition I containing the typical residual iron levels greater than about 400 ppm. It can be concluded from the above data, that with regard to glass working and sealing properties, the glass envelopes of the present invention, as set forth in Table 3, will work, seal and perform in a manner equivalent to that of the commercially available aluminosilicate glass, while providing significantly improved light transmission in the UV range.

Table 6 illustrates a comparison of two lamps having the configuration of FIG. 1 rated at 10.0 volts DC, 20 watts, operating at 15.78 to 15.79 LPW and with a nominal glass wall thickness of 0.7 mm. The lamps were built to be identical in all respects except for the composition of the glass envelopes.

TABLE 6

| Wavelength (nanometers) | Low Iron (98 ppm Fe) Aluminosilicate Glass Envelope ($W/cm^2$) Irradiance Table 3 | Commercial (400 ppm Fe) Aluminosilicate Glass Envelope ($W/cm^2$) Irradiance Corning 1724 |
|---|---|---|
| 200 | 5.26E−08 | 4.25E−08 |
| 210 | 1.50E−08 | 1.27E−08 |
| 220 | 9.69E−09 | 7.50E−09 |
| 230 | 8.22E−09 | 4.85E−09 |
| 240 | 1.00E−08 | 2.46E−09 |
| 250 | 2.02E−08 | 1.62E−09 |
| 260 | 4.49E−08 | 2.26E−09 |
| 270 | 1.00E−07 | 6.04E−09 |
| 280 | 2.45E−07 | 2.80E−08 |
| 290 | 5.37E−07 | 9.49E−08 |
| 300 | 1.05E−06 | 2.74E−07 |
| 310 | 1.92E−06 | 6.97E−07 |
| 320 | 3.37E−06 | 1.58E−06 |
| 330 | 5.31E−06 | 3.03E.06 |
| 340 | 7.90E−06 | 5.13E−06 |
| 350 | 1.10E−05 | 7.76E−06 |
| 360 | 1.52E−05 | 1.13E−05 |
| 370 | 1.98E−05 | 1.51E−05 |
| 380 | 2.43E−05 | 1.94E−05 |

The data shown in Table 6 illustrates the efficacy of the invention in a practical application. Identical lamps were built with the only significant variable being the composition of the glass envelope used in the lamp construction. One envelope was made from commercial aluminosilicate glass of Table 2, nominally Composition I, available from Corning under the tradename 1724, and the other was made from the low iron aluminosilicate glass of Table 3.

Of particular interest was the amount of transmitted energy increase at 340 nm. It can be seen from the results shown in Table 6, that the transmitted energy increase was 54.0% (5.13E-06 to 7.90E-06) when substituting the low iron glass envelope for the commercial glass envelope. It can further be seen that even more dramatic increases are evident at shorter wavelengths.

Other test configurations have yielded similar results. All tests lead to the same conclusion that lowering the iron content in an aluminosilicate glass to approximately 100 ppm or lower, and utilizing this glass composition in the envelope of a halogen or high color temperature gas filled lamp will significantly enhance the transmission and emission of UV and near UV light.

While the invention has been described in detail with reference to a single preferred embodiment, it should be apparent that many modifications and variations would present themselves to those skilled in the art without departing from the scope and spirit of this invention as defined in the appended claims.

What is claimed is:

1. A glass tungsten halogen lamp which exhibits improved short wavelength light transmission (transmittance) and emission at less than about 400 nm, and which comprises a glass envelope which is made of an aluminosilicate glass composition which contains iron in residual or trace amounts and where the concentration of iron is from about 10 ppm to 100 ppm.

2. A glass lamp which exhibits improved short wavelength light transmission and emission at less than about 400 nm, comprising a glass envelope which is made of an aluminosilicate glass composition which contains iron in residual or trace amounts and where the concentration of iron is in the range of about 10 to 100 ppm with said lamp containing a plurality of lead wires which are connected to a filament element contained within said envelope.

3. The lamp of claim 2 in which the glass envelope further contains an area of reduced wall thickness which further enhances short wavelength light transmission and emission.

4. The lamp of claim 2 in which the glass envelope is in the form of a smooth hemispherical dome, flat top or lensed end and having substantially parallel sidewalls.

5. The lamp of claim 2 in which the glass envelope is made of the following composition by weight:

$SiO_2$ 53–76%

$Al_2O_3$ 9–18%

$B_2O_3$ 0–6%

CaO 3–13%

MgO 1–9%

BaO 5–24%

Fe 10–100 ppm.

6. A glass tungsten halogen lamp which exhibits improved short wavelength light transmission and emission at less than about 400 nm, and which comprises a glass envelope which is made of an aluminosilicate glass composition which contains iron in measurable residual amounts, and where the concentration of the iron is maintained in the range of about 10 to 100 ppm.

7. A glass halogen lamp which exhibits improved short wavelength light transmission and emission comprising a glass envelope having the following composition by weight:

$SiO_2$ 53–76%

$Al_2O_3$ 9–18%

$B_2O_3$ 0–6%

CaO 3–13%

MgO 0–9%

BaO 5–24%

Fe 10–100 ppm.

* * * * *